US012004621B2

(12) United States Patent
Wallace

(10) Patent No.: US 12,004,621 B2
(45) Date of Patent: Jun. 11, 2024

(54) CARGO CARRYING AND HOLDING DEVICE, EXPANDABLE WALL SUPPORT, AND METHOD

(71) Applicant: James Wallace, Katy, TX (US)

(72) Inventor: James Wallace, Katy, TX (US)

( * ) Notice: Subject to any disclaimer, the term of this patent is extended or adjusted under 35 U.S.C. 154(b) by 75 days.

(21) Appl. No.: 17/994,252

(22) Filed: Nov. 25, 2022

(65) Prior Publication Data

US 2023/0157428 A1 May 25, 2023

Related U.S. Application Data

(60) Provisional application No. 63/283,167, filed on Nov. 24, 2021.

(51) Int. Cl.
*A45C 7/00* (2006.01)

(52) U.S. Cl.
CPC ..... *A45C 7/0022* (2013.01)

(58) Field of Classification Search
CPC ..... A45C 7/0022
USPC ..... 217/1.5, 12 R; 220/666; 428/12
See application file for complete search history.

(56) References Cited

U.S. PATENT DOCUMENTS

| | | | | |
|---|---|---|---|---|
| 3,319,684 | A * | 5/1967 | Calhoun | A61M 1/69 220/666 |
| 4,405,077 | A * | 9/1983 | Kupersmit | B65D 5/36 229/117.07 |
| 5,350,241 | A * | 9/1994 | Zoland | A45C 13/004 383/33 |
| 5,524,789 | A * | 6/1996 | Jackman | B65D 5/40 220/666 |
| 7,854,370 | B2 * | 12/2010 | Turvey | B65D 43/0218 220/666 |
| 2012/0248163 | A1 * | 10/2012 | Biddle | A45C 7/0022 224/275 |
| 2020/0022473 | A1 * | 1/2020 | Hashish | A45C 13/04 |

* cited by examiner

*Primary Examiner* — Don M Anderson
*Assistant Examiner* — Justin Caudill
(74) *Attorney, Agent, or Firm* — WItters & Associates; Steve Witters

(57) ABSTRACT

Presently provided is a cargo carrying device, an expandable wall support, and method. The cargo carrying device has one or two expandable wall supports configured to transform from a contracted orientation to an expanded orientation. The expandable wall support has legs disposed with a center hub assembly at one end and beams disposed at the other of the legs. Upon the expandable wall support being disposed in the contracted orientation, the legs are disposed substantially parallel with each other and the beams enclose the legs and the center hub assembly. Upon the expandable wall support being disposed in the expanded orientation, each of the beams is disposed to form a longitudinally extending corner and the legs are disposed to support a wall.

21 Claims, 9 Drawing Sheets

SECTION B-B

SECTION C-C

SECTION A-A

SECTION D-D

CARGO CARRYING AND HOLDING DEVICE, EXPANDABLE WALL SUPPORT, AND METHOD

CROSS REFERENCE TO RELATED APPLICATIONS

This application claims priority to U.S. provisional application No. 63/283,167, filed Nov. 24, 2021, the disclosure of which is hereby incorporated by reference in its entirety.

FIELD OF INVENTION

The present invention relates to cargo carrying and holding devices, expandable wall supports, and methods.

BACKGROUND OF THE INVENTION

Present cargo carrying and holding devices may be cumbersome to use and store when not in use. For example, carrying and holding devices presently provided for holding items in a trunk of a car may not provide for ease for moving or storing the device when not in use. It may be desired to have a cargo carrying device that easily collapsed and stored when not in use.

SUMMARY

In one aspect of the present disclosure, a cargo carrying device configured to transform from a contracted orientation to an expanded orientation is disclosed. The cargo carrying device has a first beam, a second beam, a third beam, and a fourth beam, each of the beams having a first end portion disposed at a first side of the cargo carrying device and a second end portion disposed at a second side of the cargo carrying device, wherein the first side is opposite the second side. The device has four first legs, each of the first legs having a first end in rotational cooperation with each of the first end portions of each of the beams and a first center hub assembly in rotational cooperation with a second end of each of the first legs. Upon the cargo carrying device being disposed in the expanded orientation, the first legs are disposed outwardly from each other and proximate the first side of the cargo carrying device. Upon the cargo carrying device being disposed in the contracted orientation, the first legs are disposed substantially parallel with each other. Each of the beams are configured disposed to form longitudinally extending corners of the cargo carrying device, upon the cargo carrying device being disposed in the expanded orientation, and to form an outer case enclosing the first center hub assembly and the legs, upon the cargo carrying device being disposed in the contracted orientation. The device also has an outer cover configured to wrap about the beams and the legs and form a bottom wall, a first sidewall, a second sidewall, a third sidewall, and a fourth sidewall, upon the cargo carrying device being disposed in the expanded orientation.

In another aspect of the present disclosure, a method of carrying cargo is provided. The method comprises the steps of: releasing a releasable retainer disposed with a case, the case comprising four beams; separating the four beams and expanding them into a parallel orientation; holding the four parallel beams in the parallel orientation; wherein the separating and the holding of the four beams comprises moving four first legs outwardly from a first center hub assembly and forming a first wall support; wrapping and holding a cover about the beams and the first wall support and forming four sidewalls and a bottom wall of a cargo carrying device; and placing cargo into the wrapped cargo carrying device and carrying the cargo.

In yet another aspect of the present disclosure, an expandable wall support comprises: at least three beams, each of the beams having a first end portion disposed at a first side and a second end portion disposed at a second side, wherein the first side is opposite the second side; at least three legs having a first end in rotational cooperation with each of the first end portions of each of the beams; a first center hub assembly having a first hub portion, a second hub portion, and a guide; wherein the first hub portion is in rotational cooperation with each of the three legs at a first point proximate a second end of the first legs; wherein the second hub portion is in hinged cooperation with each of the first legs at a second point, the second point being spaced from the first point and nearer the first end of the first legs; wherein upon the wall support being disposed in the expanded orientation, the first hub portion is disposed adjacent or proximate the second hub portion along the guide and the first legs are disposed outwardly from each other and proximate the first side of the wall support; wherein upon the wall support being disposed in a contracted orientation, the first hub portion is disposed apart from the second hub along the guide and the first legs are disposed substantially parallel with each other; each of the beams being configured and disposed to form longitudinally extending corners of the wall support, upon the wall support being disposed in the expanded orientation, and to form an outer case enclosing the first center hub assembly and the legs, upon the wall support being disposed in the contracted orientation.

In a further aspect, an expandable sidewall support is provided, the support comprising: a first beam, a second beam, a third beam, and a fourth beam, each of the beams having a first end portion disposed at a first side and a second end portion disposed at a second side, wherein the first side is opposite the second side; four first legs, each of the first legs having a first end in rotational cooperation with each of the first end portions of each of the beams; a first center hub assembly having a first hub portion, a second hub portion, and a guide; wherein the first hub portion is in rotational cooperation with each of the first legs at a first point proximate a second end of the first legs; wherein the second hub portion is in hinged cooperation with each of the first legs at a second point, the second point being spaced from the first point and nearer the first end of the first legs; wherein upon the sidewall support being disposed in the expanded orientation, the first hub portion is disposed adjacent or proximate the second hub portion along the guide and the first legs are disposed outwardly from each other and proximate the first side of the sidewall support; wherein upon the sidewall support being disposed in the contracted orientation, the first hub portion is disposed apart from the second hub along the guide and the first legs are disposed substantially parallel with each other; each of the beams being configured and disposed to form longitudinally extending corners of the sidewall support, upon the sidewall support being disposed in the expanded orientation, and to form an outer case enclosing the first center hub assembly and the legs, upon the sidewall support being disposed in the contracted orientation.

BRIEF DESCRIPTION OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are therefore, not to be considered limiting of its scope, the disclosure will be described with additional specificity and detail through use of the accompanying drawings.

The following figures, which are idealized, are not to scale and are intended to be merely illustrative of aspects of the present disclosure and non-limiting. In the drawings, like elements may be depicted by like reference numerals. The drawings are briefly described as follows.

DETAILED DESCRIPTION OF THE INVENTION

Figure 1A:
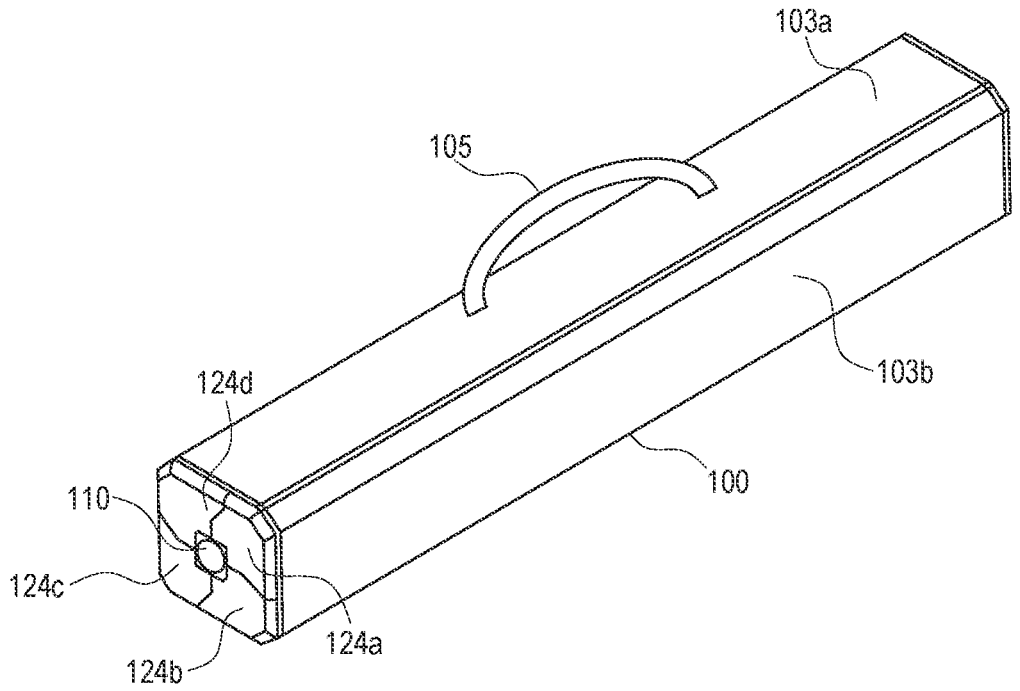
FIG. 1*a* shows an illustrative example of the presently disclosed expandable wall support and cargo carrying and holding device in a collapsed and closed configuration.

Presently disclosed is a cargo carrying and holding device, an expandable wall support, and methods. Example uses of the presently disclosed cargo carrying and holding device may provide for trunk protection, cargo holding, carrying or moving items, or as an organizer. For example, the presently disclosed cargo carrying and holding device may be used to protect the interior of a vehicle from mud, dirt, moisture, and debris as may be caused by the transportation of cargo or items such as outdoor sporting goods. In addition to being used for holding and carrying cargo, or other items, general vehicle protection may be provided with the presently disclosed cargo carrying and holding device. For example, those who wish to protect their vehicle from such things as hardware store purchases, wet dogs, and other items of a similar nature, may obtain a desired auto protection with the use of the presently disclosed cargo carrying and holding device.

The cargo carrying device has one or two expandable wall supports configured to transform from a contracted orientation to an expanded orientation. The expandable wall support has legs disposed with a center hub assembly at one end and beams disposed at the other of the legs. Upon the expandable wall support being disposed in the contracted orientation, the legs are disposed substantially parallel with each other and the beams enclose the legs and the center hub assembly. Upon the expandable wall support being disposed in the expanded orientation, each of the beams is disposed to form a longitudinally extending corner and the beams are disposed to support a wall.

The presently disclosed cargo carrying and holding device may be advantageous for owners of cars and sport utility vehicles. For example, it may effectively serve as a replacement for a pick-up truck bed for these vehicles. The presently disclosed cargo carrying and holding device may be easily moved to storage shelves or left closed in a vehicle when not in use. Embodiments may have a removable bib or cover disposed about at least one expandable wall support. The cover may be configured to be replaced and may be printed with insignia, sports team logos, company logos, and other art or works. The presently disclosed cargo carrying and holding device may have a center cavity boot which may provide for holding long thin sporting goods or other materials.

The presently disclosed expandable wall support and the presently disclosed cargo carrying and holding device may have components parts comprised of steel, molded plastic, machined or extruded aluminum, springs, neodymium magnets, ballistics laminated nylon, nylon heavy sewing string, fasteners, high strength hook and loop fasteners, such as Velcro©, zippers, adhesive, nitinol wire, and other materials as are known in the art.

The presently disclosed cargo carrying and holding device may be a consumer product which may be sold at retail stores and through eCommerce. For example, the device may be offered for sale in automobile parts stores or in the sporting goods section of a store or near outdoor sporting furniture section or center display of a sporting goods store.

The presently disclosed cargo carrying and holding device is configured to be transformed into two positions, an open or expanded orientation and a closed or contracted orientation. In a closed position, it may be configured to be locked into a durable case, which may be approximately 6" H x 6" W x 36" L. The case may be formed with beams that may expand to form wall supports. In an open position, it may unfold or expand and be wrapped with a cover to form sidewalls and a bottom or top wall. For example, a patterned cover may be configured to wrap around an expanded structure and be held thereto. The cover may be a fabric material or other pliable material. The wrapped structure may provide a lined cuboid shape, supported by four beams, and one or two folding X shaped frame support mechanisms. The X frame support mechanism(s) may be under pressure tension creating a spring-open effect when unlocked or released. The X frame support mechanism(s) may support one or both ends of the beams.

In at least one embodiment, the presently disclosed cargo carrying and holding device and the presently disclosed expandable wall support are configured to self-expand or open, by way of springs. In at least one embodiment, the presently disclosed expandable wall support may have a cover about legs and beams. For example, a cover may be wrapped and held about an expandable wall support to provide a cargo carrying and holding device. The cover may be a removable bib panel or cover, which may be configured to act like a pick-up tail gate.

FIG. 1*a* shows an illustrative example of the presently disclosed expandable wall support 115, comprising a center hub assembly 101 and legs 104, which may be configured to be wrapped with a cover and form a cargo carrying and holding device, 100, in a closed configuration or retracted orientation. When not in use, cargo carrying and holding device 100, or expandable wall support 115, may be placed in a closed or contracted configuration. In the closed configuration, cargo carrying and holding device 100, or expandable wall support 115, may have a top, ends, bottom, rear, and front. Insignia may be disposed on an outer surface of closed cargo carrying and holding device, or expandable wall support, 100. In this closed configuration, cargo carrying and holding device 100, or expandable wall support 115, may be easily moved and conveniently stored for future use. For example, a handle 105 may be disposed on an outer surface of expandable wall support 115 for carrying or moving, when in an expanded and contracted configuration.

Upon expandable wall support 115 being disposed in the contracted orientation, beams 103*a*, 103*b*, 103*c*, and 103*d*, are held together to form an outer case enclosing the wall support mechanism(s) or expandable wall support(s). The beams may each have corner bracket, such as one of corner bracket 124*a*, 124*b*, 124*c*, and 124*d*, disposed on an end thereof. Releasable retainer 110 may be centrally disposed with the corner brackets.

Figure 1B:
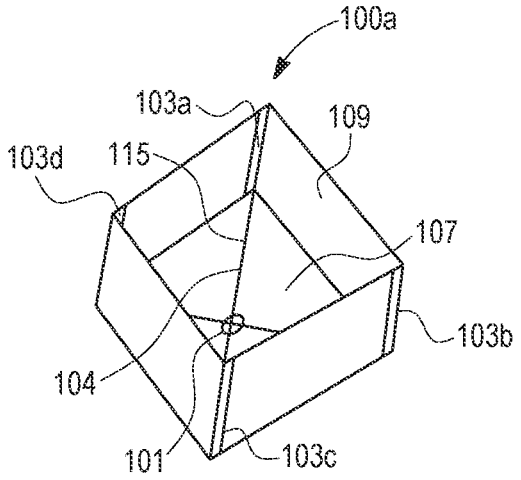
FIGS. 1*b* and 1*c* shows illustrative examples of the presently disclosed expandable wall support or cargo carrying and holding device in an expanded configuration for holding and carrying cargo.
Figure 1C:
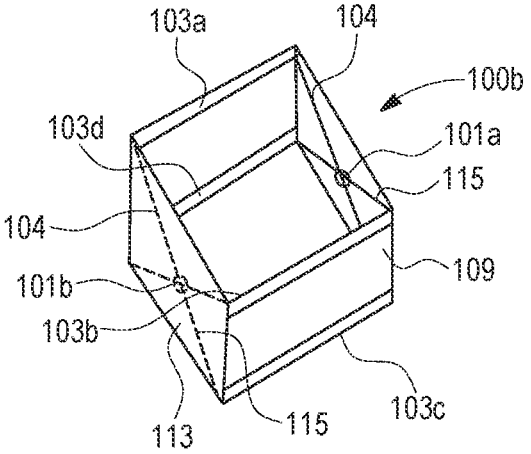

FIGS. 1*b* and 1*c* show illustrative examples of the presently disclosed cargo carrying and holding device and the presently disclosed expandable wall support. Expandable wall support 100*a* has legs 104, extending from hub assembly 101, disposed proximate and supporting bottom wall or top wall 107. Outer cover over 109 is wrapped about beams 103*a*, 103*b*, 103*c*, and 103*d*, legs 104, and center hub assembly 101, forming the bottom wall or top wall 107 and sidewalls 113. Sidewalls 113 extend from bottom or top wall 107. In at least one embodiment, expandable wall support 100*a* has legs 104 and center hub assembly disposed to support a bottom wall 107. Wrapping cover 109 about the beams and legs may provide for the presently disclosed cargo carrying device. In at least one other embodiment, expandable wall support 100*a* has legs 104 and center hub assembly disposed to support a top wall 107. Wrapping outer cover over 109 about beams 103*a*, 103*b*, 103*c*, and 103*d*, legs 104, and center hub assembly 101, may form a structure having a top wall 107 and sidewalls 113. Sidewalls 113 extend down from top wall 107 which may provide for an open bottomed structure. For example, legs 104 and cover 109 may be sized and configured to provide a structure such as a tent with a top wall.

FIG. 1*c* shows first four legs 104 extending from first center hub assembly 101*a* and being disposed proximate, and supporting, a first sidewall of cargo carrying device 100*b*. Second four legs 104 extend from second center hub assembly 101*b* and are disposed proximate, and support, a second sidewall of cargo carrying device 100*b*. The first sidewall is opposite the second sidewall. Outer cover over 109 is wrapped about beams 103*a*, 103*b*, 103*c*, and 103*d*, first and second legs 104, and center hub assemblies 101*a* and 101*b*, forming the bottom wall and sidewalls. Sidewalls 113 extend up from the bottom wall.

Figure 2A:
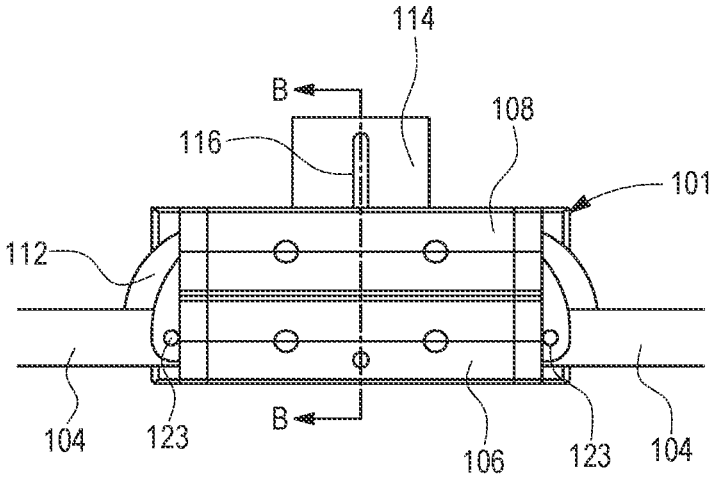
FIGS. 2*a* and 2*b* show a side and a cross-sectional view of an illustrative example of a center hub assembly disposed in an expanded orientation.
Figure 2B:
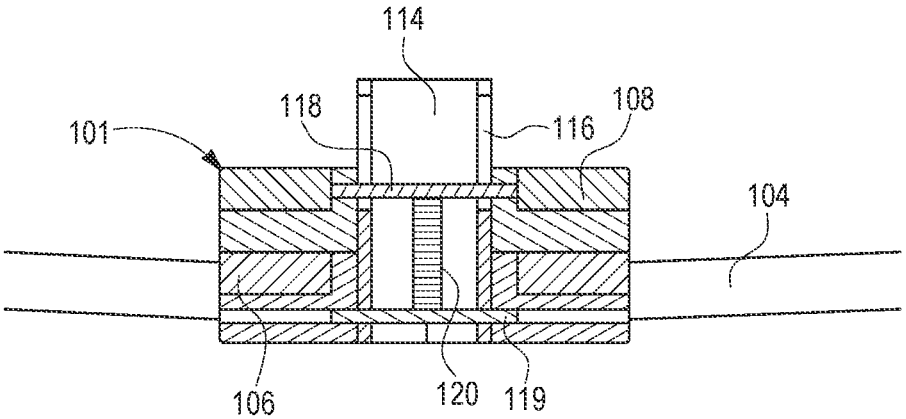
Figure 3A:
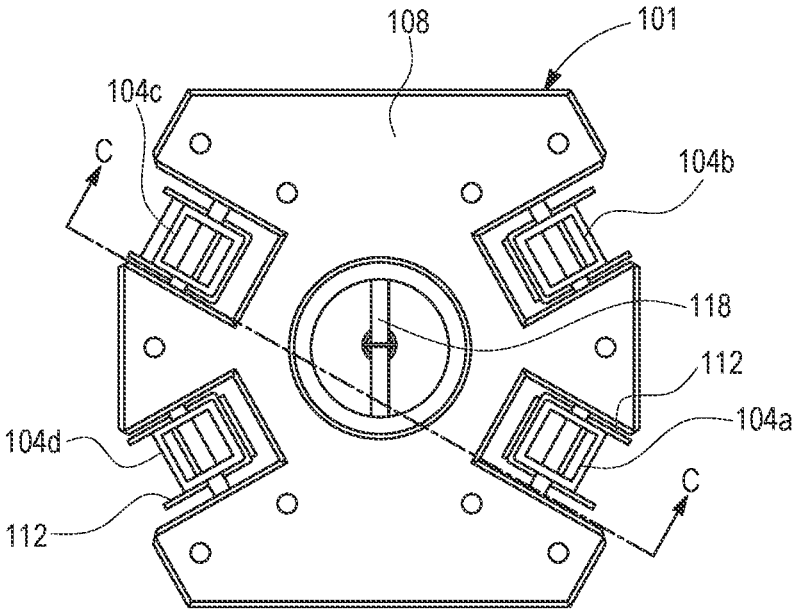
FIGS. 3*a* and 3*b* show a top view and a cross-sectional view, respectively, of the center hub assembly shown in FIGS. 2*a* and 2*b* in a contracted orientation.
Figure 3B:
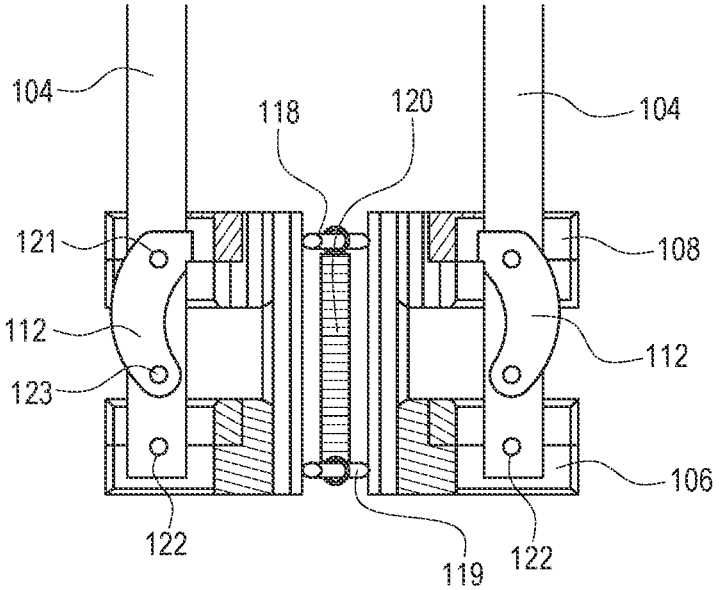

FIGS. 2*a* and 2*b* show a side and a cross-sectional view of an illustrative example of a center hub assembly 101 disposed in an expanded orientation. FIGS. 3*a* and 3*b* show a top view and a cross-sectional view, respectively, of center hub assembly 101 disposed in a contracted orientation. Center hub assembly 101 may be configured to expand and hold a plurality of legs 104 proximate a sole plane and provide an expandable sidewall support. For example, center hub assembly 101 may have three or more legs 104, such as four, in rotational cooperation therewith. In at least one embodiment, center hub assembly 101 has a first hub portion 106, a second hub portion 108, and a guide 114.

First hub portion 106 is in rotational cooperation with each of the legs 104 at a first point 122, proximate a second end of legs 104. The first end of legs 104 being in rotational cooperation with beams 103. Second hub portion 108 is in hinged cooperation with each of the legs 104 at a second point 123, with hinge 112. Second point 123 being spaced from the first point 122 and disposed nearer the first end of legs 104. Hinge 112 is rotationally held to second hub portion 108 at rotational cooperation point 121. Guide 114 extends from first hub portion 106 and is slidingly received with second hub portion 108.

Guide 114 extends from first hub portion 106 and through a central opening in second hub portion 108. Second hub portion 108 is configured and disposed to move away from, and toward, first hub portion 106, about guide 114. Guide 114 has a slot 116 and second hub portion 108 has a spring support 118 extending through slot 116. First hub portion 106 has spring support 119 extending through guide 114 and first hub support 106, holding guide 114 to first hub support 106. Spring 120 is a tension spring and extends from first spring support 118 to second spring support 119. Spring 120 is configured and disposed to pull second hub portion 108 toward first hub portion 106 and bias hub assembly 101 into an expanded orientation and moving legs 104 outwardly toward a plane, as shown in FIGS. 2*a* and 2*b*.

Figure 4A:
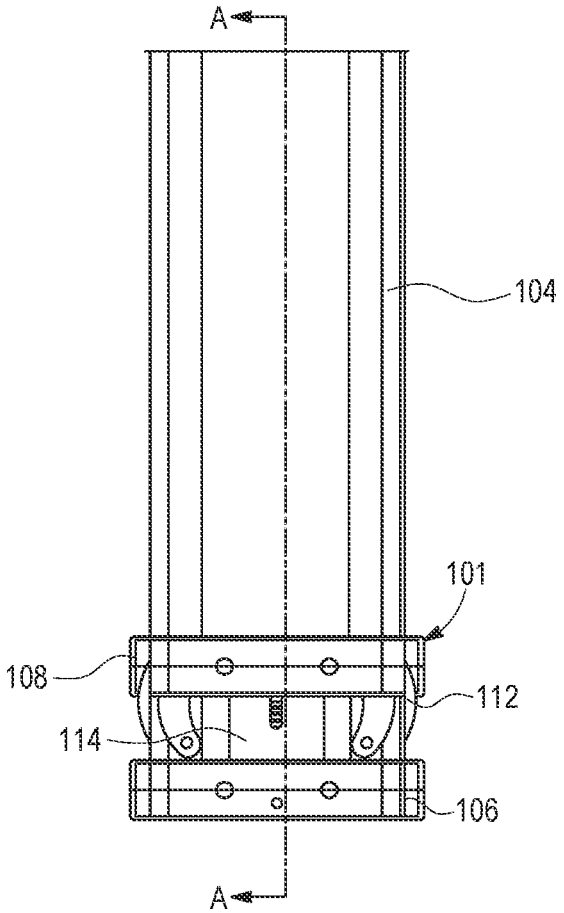
FIGS. 4*a* and 4*b* show a side and a cross-sectional view of the center hub assembly shown in FIGS. 2*a* and 2*b* disposed in a contracted orientation.
Figure 4B:
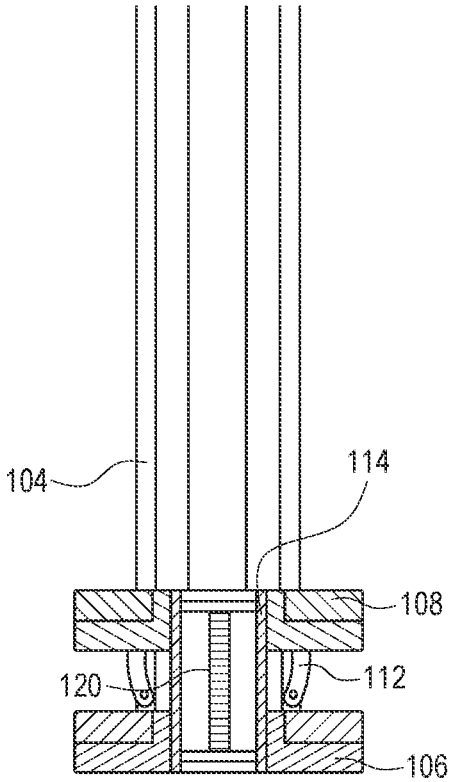
Figure 5A:
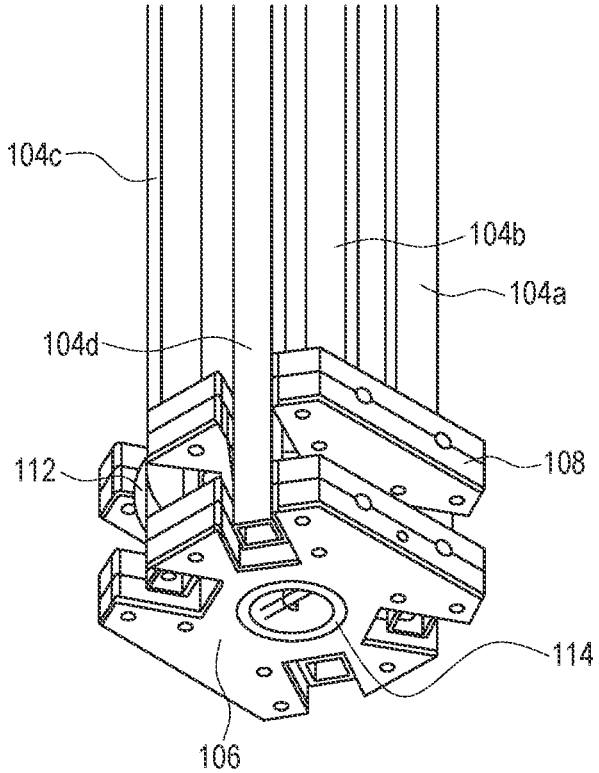
FIGS. 5*a* and 5*b* show perspective views of the center hub assembly shown in FIGS. 2*a* and 2*b* disposed in a contracted orientation.
Figure 5B:
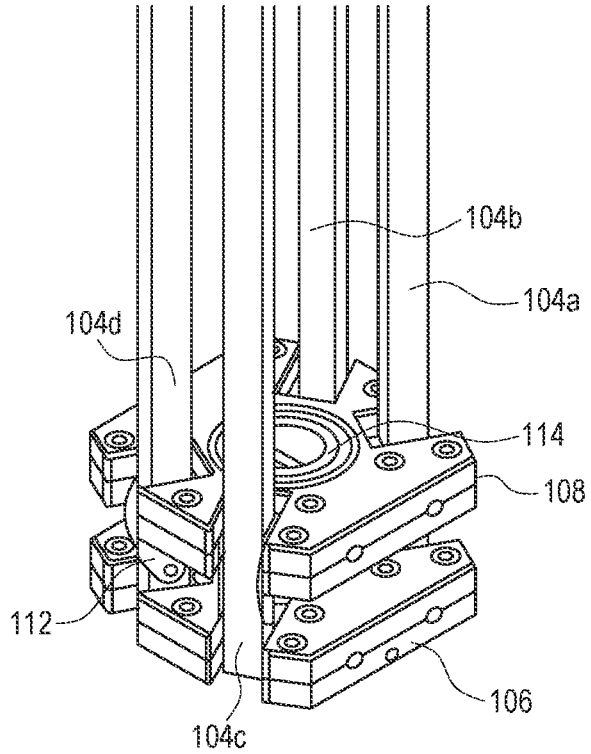

FIGS. 3*a* and 3*b* show center hub assembly 101 in a contracted orientation. FIGS. 4*a* and 4*b* show a side and a cross-sectional view of center hub assembly 101, and FIGS. 5*a* and 5*b* show perspective views of center hub assembly 101, wherein hub assembly 101 is in the contracted orientation. Hub assembly 101 is configured to provide that as legs 104 are moved toward each other and a parallel orientation, spring 120 is tensioned and second hub portion 108 is moved away from first hub portion 106, with hinge 112. FIG. 3*a* and FIGS. 5*a* and 5*b* show first leg 104*a*, second leg 104*b*, third leg 104*c*, and forth leg 104*d* disposed in a contracted orientation, wherein the legs are disposed substantially parallel with one another.

Figure 6A:
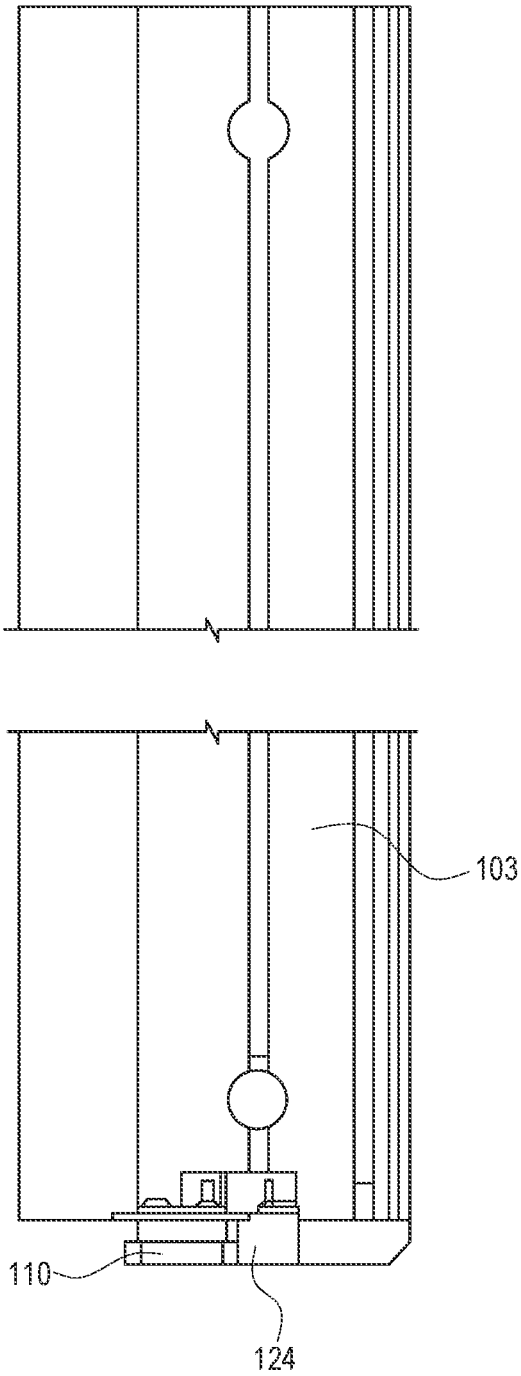
FIGS. 6*a* and 6*b* show a front view and a perspective view of a beam having a releasable retainer disposed therewith.
Figure 6B:
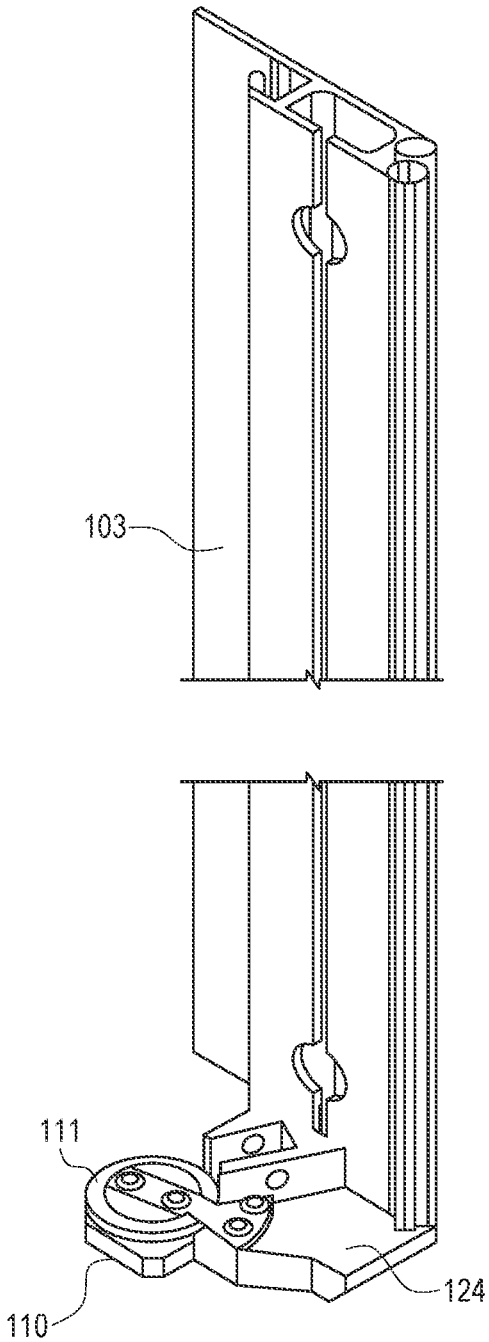

FIGS. 6*a* and 6*b* show a front view and a perspective view of beam 103 having a releasable retainer 124 disposed therewith. In at least one embodiment of the present disclosure, the cargo carrying device has a first beam 103*a*, a second beam 103*b*, a third beam 103*c* and a fourth beam 103*d*, as shown in FIGS. 1*a*-1*c*. Each of the beams has a first end portion disposed at a first side of the cargo carrying device and a second end portion disposed at a second side of the cargo carrying device, wherein the first side is opposite the second side. One of the beams has a hold and release mechanism 110 disposed at one end, which may be disposed with a corner bracket 124. Beam 103 is configured and disposed to form longitudinally extending corners of a sidewall support, upon the sidewall support being disposed in the expanded orientation, as shown in FIGS. 1*b* and 1*c*. Beam 103 is configured to form an outer case enclosing at least one center hub assembly and the legs extending therefrom, upon the sidewall support being disposed in the contracted orientation, as shown in FIG. 1*a*.

Figure 7A:
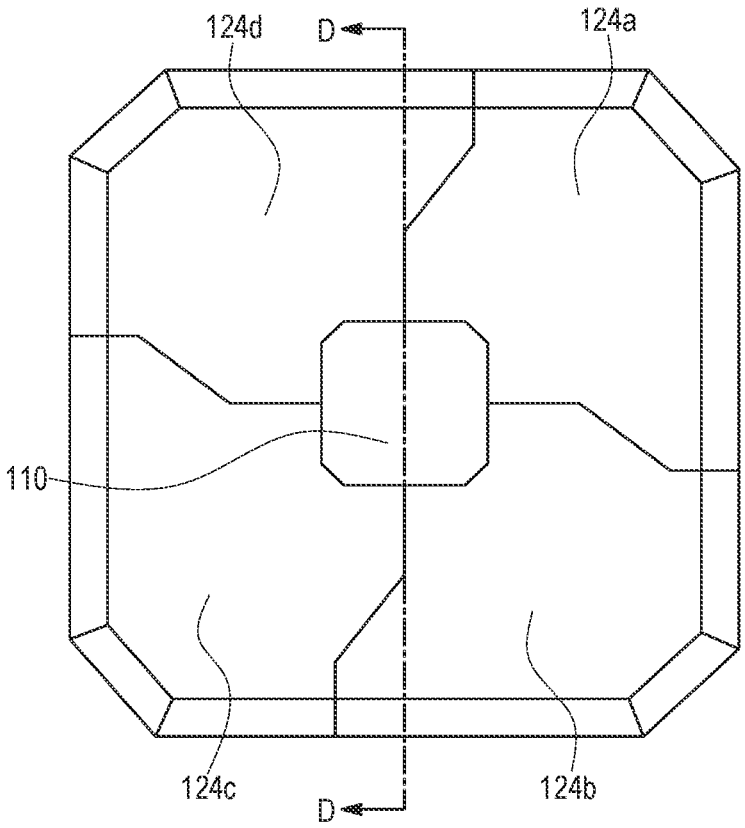
FIGS. 7*a* and 7*b* show an end view and a cross-sectional view of corner brackets disposed with, and about, releasable retainer, or hold and release mechanism.
Figure 7B:
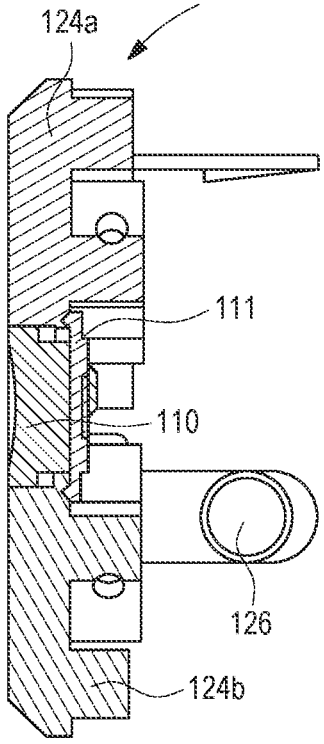
Figure 8A:
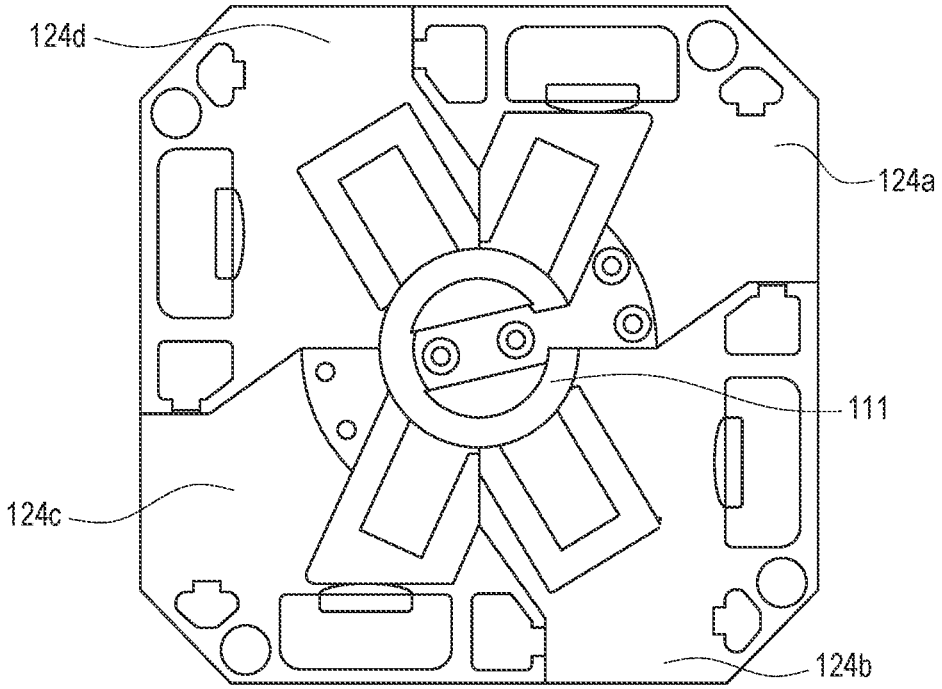
FIGS. 8*a* and 8*b* show an inside view and a perspective view of the corner brackets shown in FIGS. 7*a* and 7*b*.
Figure 8B:
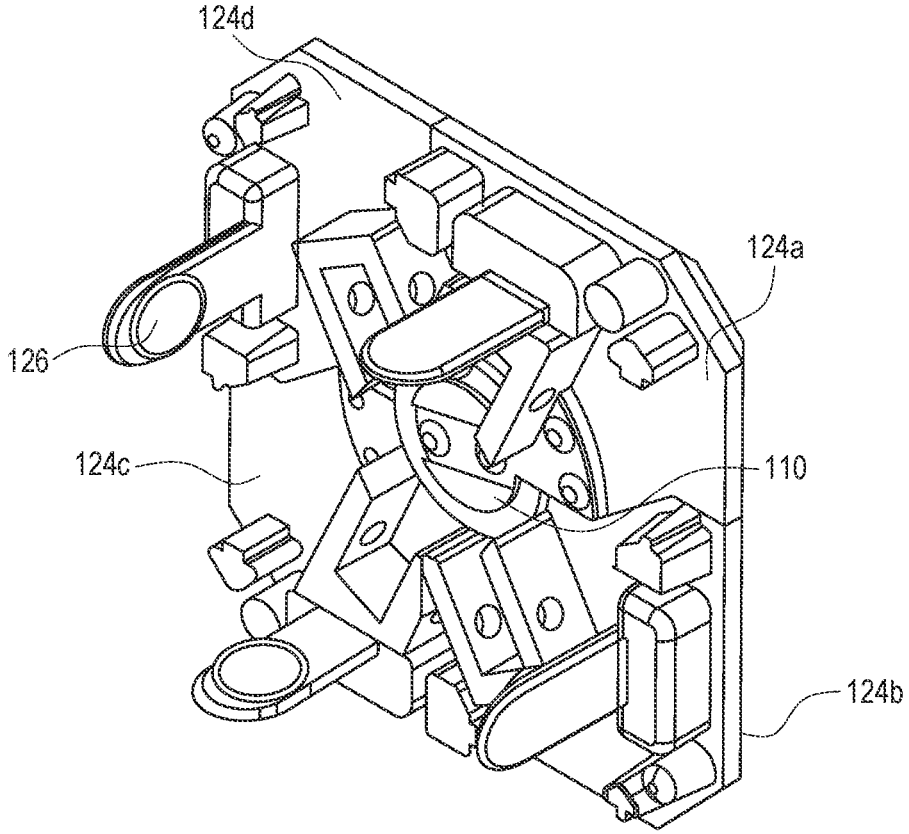

FIGS. 7*a* and 7*b* show an end view and a cross-sectional view of corner brackets 124 disposed with and about a releasable retainer, or hold and release mechanism 110 and FIGS. 8*a* and 8*b* show an inside view and a perspective view the corner brackets 124. First corner bracket 124*a*, second corner bracket 124*b*, third corner bracket 124*c*, and fourth corner bracket 124*d* are each configured and disposed to be held with, and extend, from an end of a beam 103 as shown in FIGS. 6*a* and 6*b*. Each of the corner brackets has a connector 126 configured for connecting the corner bracket with a beam 103. One of the corner brackets, such as corner bracket 124*a* as shown, has hold and release mechanism 110 extending therefrom. The other corner brackets are void of hold and release mechanism 110 and are configured to be disposed about hold and release mechanism 110, upon the device being in a retracted orientation.

With reference to FIG. 7*b*, hold and release mechanism 110 may have a push button springingly attached to one of the beam corner brackets, such as corner bracket 124*a*. Hold and release mechanism 110 has beam retainer 111 configured and disposed cooperate with the brackets and hold them together in the collapsed orientation. Upon pressing hold and release mechanism 110, beam retainer 111 is removed from cooperation with the corner brackets and beams, releasing the beams to expand into the expanded orientation. For example, a button on the end of a case comprising the beams as its outer shell may be pressed and the support mechanism may automatically expand with the force of spring 120.

In at least one embodiment of the present disclosure, an expandable sidewall support has a first beam 103*a*, a second beam 103*b*, a third beam 103*c*, and a fourth beam 103*d*, each of the beams having a first end portion disposed at a first side and a second end portion disposed at a second side, wherein the first side is opposite the second side. Four first legs, first leg 104*a*, second leg 104*b*, third leg 104*c*, and forth leg 104*d*, each have a first end in rotational cooperation with each of the first end portions of each of the beams. A first center hub assembly 101 has a first hub portion 106, a second hub portion 108, and a guide 114. First hub portion 106 is in rotational cooperation with each of the first legs at a first point 122 proximate a second end of the first legs and second hub portion 108 is in hinged cooperation with each of the first legs at a second point 123, the second point being spaced from the first point and nearer the first end of the first legs Upon the sidewall support being disposed in the expanded orientation, the first hub portion 106 is disposed adjacent the second hub portion 108, along guide 114, and the first legs are disposed outwardly from each other and proximate the first side of the sidewall support.

Upon the sidewall support being disposed in the contracted orientation, the first hub portion 106 is disposed apart from the second hub 180 along the guide 114 and the first legs are disposed substantially parallel with each other. Each of the beams are configured and disposed to form longitudinally extending corners of the sidewall support, upon the sidewall support being disposed in the expanded orientation, and to form an outer case enclosing the first center hub assembly and the legs, upon the sidewall support being disposed in the contracted orientation.

Upon the sidewall support being disposed in the expanded orientation, the first hub portion is disposed adjacent or proximate the second hub portion along the guide and the first legs are disposed outwardly from each other and proximate the first side of the sidewall support.

Upon the sidewall support being disposed in the contracted orientation, the first hub portion is disposed apart from the second hub along the guide and the first legs are disposed substantially parallel with each other. Each of the beams are configured disposed to form longitudinally extending corners of the sidewall support, upon the sidewall support being disposed in the expanded orientation, and to form an outer case enclosing the first center hub assembly and the legs, upon the sidewall support being disposed in the contracted orientation.

Figure 9A:
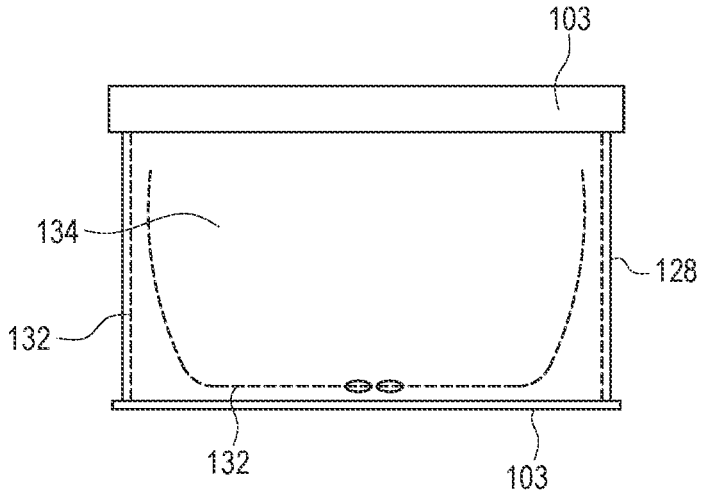
FIGS. 9*a* and 9*b* shown a top view and a side view, respectively, of an illustrative example of an outer cover configured to wrap about the legs of the expandable wall support to form walls about the expandable wall support.
Figure 9B:
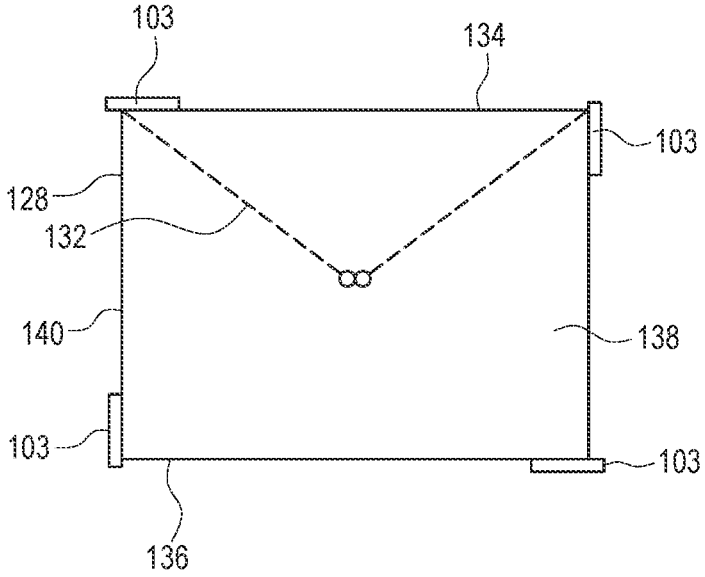

FIGS. 9*a* and 9*b* show views of a patterned material that may be used in one or more embodiments of a cargo carrying and holding device 100. FIGS. 9*a* and 9*b* show a top view and a side view, respectively, of cover 128 configured to wrap about legs 104 of expandable wall supports to form walls about the expandable wall supports. For example, a fabric, or other pliable material, may be configured to go around and cover an expanded frame and form sidewalls 140, top wall 134, and a bottom wall 136 and form a cargo carrying and holding device 100. In at least one embodiment, patterned cover 128 is a fabric, or other suitable material, wrapped about two expanded sidewall supports 115 such as the embodiment shown in FIG. 1*c* having first hub assembly 101*a*, second hub 101*b* and legs 104 supporting opposite sides. Fabric pattern 138 may have splines at longitudinally extending corners configured to fit in channels in beams 103 and hold fabric pattern on an inner surface of beams 103.

Top wall 134 may have zippers 132 extending between beams 103 configured and disposed to removably hold cover around the sidewall supports 115. Another zipper 132 may be disposed with top wall 134 to provide a top reclosable opening. Front wall 138 may have a further zipper 132 configured and disposed to provide a reclosable opening in the front of cargo carrying and holding device 100 which may face a driver's seat in an automobile.

NOMENCLATURE

| | |
|---|---|
| cargo carrying device | 100 |
| center hub assembly | 101 |
| first hub assembly | 101a |
| second hub assembly | 101b |
| beam | 103 |
| first beam | 103a |
| second beam | 103b |
| third beam | 103c |
| fourth beam | 103d |
| leg | 104 |
| first leg | 104a |
| second leg | 104b |
| third leg | 104c |
| forth leg | 104d |
| handle | 105 |
| first hub portion | 106 |
| bottom wall or top wall | 107 |
| second hub portion | 108 |
| cover | 109 |
| hold and release mechanism | 110 |
| beam retainer | 111 |
| hinge | 112 |
| sidewall | 113 |
| guide | 114 |
| expandable wall support | 115 |
| slot | 116 |
| first spring support | 118 |
| second spring support | 119 |
| spring | 120 |
| rotational cooperation point | 121 |
| rotational cooperation point | 122 |
| second hinge cooperation point | 123 |
| corner bracket | 124 |
| first corner bracket | 124a |
| second corner bracket | 124b |
| third corner bracket | 124c |
| fourth corner bracket | 124d |
| connector | 126 |
| patterned cover | 128 |
| fastener or zipper | 132 |

-continued

| | |
|---|---|
| top wall | 134 |
| bottom wall | 136 |
| front wall | 138 |

It will be understood that the examples of patents, published patent applications, and other documents which are included below in this application and which are referred to in paragraphs which state "Some examples of . . . which may possibly be used in at least one possible embodiment of the present application . . . " may possibly not be used or useable in any one or more embodiments of the application. These references, or portions thereof, are hereby incorporated by reference herein. The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of features which may possibly be utilizable by at least one possible embodiment may possibly be found in the following, which are incorporated by reference herein: U.S. Pat. No. 6,065,873, titled "Foldable self-standing carry-all", filed Mar. 1, 1999, by Fowler, Margaret E; U.S. Pat. No. 8,985,432, titled "Reusable foldable shipping container", filed Oct. 23, 2013, by Cullen et al.; U.S. Pat. No. 8,701,950, titled "Collapsible automobile storage container", by Roach et al., filed Apr. 13, 2012; and US 2 10092074, titled "Multipurpose storage device and method" by Rothschild, filed Sep. 30, 2016.

The invention claimed is:

1. A cargo carrying device configured to transform from a contracted orientation to an expanded orientation, the cargo carrying device comprising:

a first beam, a second beam, a third beam, and a fourth beam, each of the beams having a first end portion disposed at a first side of the cargo carrying device and a second end portion disposed at a second side of the cargo carrying device, wherein the first side is opposite the second side;

four first legs, each of the first legs having a first end in rotational cooperation with each of the first end portions of each of the beams;

a first center hub assembly in rotational cooperation with a second end of each of the first legs;

wherein upon the cargo carrying device being disposed in the expanded orientation, the first legs are disposed outwardly from each other and proximate the first side of the cargo carrying device;

wherein upon the cargo carrying device being disposed in the contracted orientation, the first legs are disposed substantially parallel with each other;

each of the beams being configured disposed to form longitudinally extending corners of the cargo carrying device, upon the cargo carrying device being disposed in the expanded orientation, and to form an outer case enclosing the first center hub assembly and the legs, upon the cargo carrying device being disposed in the contracted orientation; and an outer cover configured to wrap about the beams and the legs and form a bottom wall, a first sidewall, a second sidewall, a third sidewall, and a fourth sidewall, upon the cargo carrying device being disposed in the expanded orientation.

2. The cargo carrying device of claim 1, wherein the first center hub assembly has a first hub portion, a second hub portion, and a guide;

wherein the first hub portion is in the rotational cooperation with each of the first legs at a first point proximate the second end of the first legs;

wherein the second hub portion is in hinged cooperation with each of the first legs at a second point, the second point being spaced from the first point and nearer the first end of the first legs;

wherein upon the cargo carrying device being disposed in the expanded orientation, the first hub portion is disposed adjacent the second hub portion along the guide; and wherein upon the cargo carrying device being disposed in the contracted orientation, the first hub portion is disposed apart from the second hub portion along the guide.

3. The cargo carrying device of claim 2, further comprising a spring configured and disposed to bias the first hub portion to the second hub portion, along the guide, and thereby biasing the cargo carrying device into the expanded orientation.

4. The cargo carrying device of claim 1, further comprising a releasable retainer configured and disposed to releasable hold the carrying device in the contracted orientation.

5. The cargo carrying device of claim 1, wherein each of the first end portions of the beams has a corner bracket, each of the corner brackets has the first end of one of the legs in the rotational cooperation therewith.

6. The cargo carrying device of claim 5, further comprising a releasable retainer disposed with one of the corner brackets, each of the corner brackets being configured and disposed to releasable hold the corner brackets together and to release the corner brackets from each other, upon activation of the releasable retainer.

7. The cargo carrying device of claim 1, wherein upon the cargo carrying device being disposed in the expanded orientation, the first legs and the first center hub assembly being disposed proximate the first side of the cargo carrying device and supporting the bottom wall.

8. The cargo carrying device of claim 1, further comprising second center hub assembly and four second legs, each of the second legs having a first end in rotational cooperation with each of the second end portions of each of the beams, the second center hub assembly having a first hub portion, a second hub portion, and a guide, the second hub portion is in rotational cooperation with each of the second legs at a first point proximate a second end of the second legs, the second hub portion is in hinged cooperation with each of the second legs at a second point, the second point being spaced from the first point and nearer the first end of the second legs, and wherein upon the cargo carrying device being disposed in the expanded orientation, the first hub portion is disposed adjacent the second hub portion along the guide and the second legs are disposed outwardly from each other and proximate the second side of the cargo carrying device.

9. A method of carrying cargo comprising the steps of:
releasing a releasable retainer disposed with a case, the case comprising four beams;
separating the four beams and expanding them into a parallel orientation;
holding the four parallel beams in the parallel orientation;
wherein the separating and the holding of the four beams comprises moving four first legs outwardly from a first center hub assembly and forming a first wall support;
wrapping and holding a cover about the beams and the first wall support and forming four sidewalls and a bottom wall of a cargo carrying device; and
placing cargo into the wrapped cargo carrying device and carrying the cargo.

10. The method of carrying cargo of claim 9, wherein the forming of the first wall support comprises forming a bottom wall support.

11. The method of carrying cargo of claim 9, wherein the separating and the holding of the four beams further comprises moving four second legs outwardly from a second center hub assembly and forming a second wall support, the second wall support is opposite the first wall support.

12. The method of carrying cargo of claim 11, wherein the step of separating the four beams comprises moving the first center hub assembly away from the second center hub assembly.

13. The method of carrying cargo of claim 9, further comprising biasing the beams toward the expanded orientation and automatically separating the beams upon the releasing of the releasable retainer.

14. The method of carrying cargo of claim 13, wherein the separating of the four beams and expanding them into a parallel orientation comprises separating a first hub portion from a second hub portion, of the first center hub assembly, with a spring.

15. The method of carrying cargo of claim 9, further comprising removing the cargo from the cargo carrying device, removing the cover from the beams and the legs, moving the four beams together, holding the four beams together with the releasable retainer, and forming the case, wherein the case surrounds the beams and the legs.

16. An expandable wall support comprising:
at least three beams, each of the beams having a first end portion disposed at a first side and a second end portion disposed at a second side, wherein the first side is opposite the second side;
at least three legs having a first end in rotational cooperation with each of the first end portions of each of the beams;
a first center hub assembly having a first hub portion, a second hub portion, and a guide;
wherein the first hub portion is in rotational cooperation with each of the three legs at a first point proximate a second end of the first legs;
wherein the second hub portion is in hinged cooperation with each of the first legs at a second point, the second point being spaced from the first point and nearer the first end of the first legs;
wherein upon the wall support being disposed in the expanded orientation, the first hub portion is disposed adjacent or proximate the second hub portion along the guide and the first legs are disposed outwardly from each other and proximate the first side of the wall support;
wherein upon the wall support being disposed in a contracted orientation, the first hub portion is disposed apart from the second hub along the guide and the first legs are disposed substantially parallel with each other;
each of the beams being configured and disposed to form longitudinally extending corners of the wall support, upon the wall support being disposed in the expanded orientation, and to form an outer case enclosing the first center hub assembly and the legs, upon the wall support being disposed in the contracted orientation.

17. The expandable wall support of claim 16, wherein the at least three beams comprises four beams and the at least three legs comprises four legs.

18. The expandable wall support of claim 17, wherein the four beams comprise a first beam, a second beam, a third beam, and a fourth beam, each of the beams having a first end portion disposed at a first side and a second end portion disposed at a second side, wherein the first side is opposite the second side;
the expandable wall support further comprising:
four second legs, each of the second legs having a first end in rotational cooperation with each of the second end portions of each of the beams;
a second center hub assembly having a first hub portion, a second hub portion, and a guide;
wherein the first hub portion is in rotational cooperation with each of the second legs at a first point proximate a first end of the second legs;
wherein the second hub portion is in hinged cooperation with each of the second legs at a second point, the second point being spaced from the first point and nearer the first end of the second legs;
wherein upon the wall support being disposed in the expanded orientation, the first hub portion is disposed adjacent or proximate the second hub portion along the guide and the second legs are disposed outwardly from each other and proximate the second side of the wall support;
wherein upon the wall support being disposed in the contracted orientation, the first hub portion is disposed apart from the second hub along the guide and the second legs are disposed substantially parallel with each other;
upon the wall support being disposed in the expanded orientation, the first four legs being disposed to support a first wall, the second four legs being disposed to support a second wall, wherein the first wall is opposite the second wall, and each of the beams extend from the first ends of first legs and to the first ends of the second legs and are configured and disposed to form longitudinally extending corners of the wall support;
upon the wall support being disposed in the contracted orientation, the beams are configured and disposed to form an outer case enclosing the first and the second center hub assemblies, the first legs, and the second legs.

19. The expandable wall support of claim 16, further comprising a patterned cover, the patterned cover being configured to be held about the beams and the legs and form walls and at least one of a top wall and a bottom wall.

20. The expandable wall support of claim 16, further comprising a tension spring configured and disposed to bias the first hub portion toward the second hub portion and the wall support into the expanded orientation.

21. The expandable wall support of claim 20, further comprising a hold and release mechanism in cooperation with a beam retainer, wherein the beam retainer is configured and disposed to hold the first ends of the beams together in the closed orientation and an activation of the hold and release mechanism is configured and disposed to release the beams from the beam retainer and automatically expand the expandable wall support into the expanded orientation.

* * * * *